US005154399A

United States Patent [19]

Swanson

[11] Patent Number: 5,154,399

[45] Date of Patent: Oct. 13, 1992

[54] IMPLEMENT FOR REMOVING LANDSCAPE EDGING

[76] Inventor: Ernest E. Swanson, 6252 Brooklyn Dr., Brooklyn Center, Minn. 55430

[21] Appl. No.: 723,794

[22] Filed: Jul. 1, 1991

[51] Int. Cl.[5] ..... B66F 3/00

[52] U.S. Cl. ..... 254/131

[58] Field of Search ..... 254/132, 131, 129, 130, 254/DIG. 3, 120, 30, 113

[56] References Cited

U.S. PATENT DOCUMENTS

| | | | |
|---|---|---|---|
| 207,098 | 8/1878 | Barwick . | |
| 227,620 | 5/1880 | Downing | 254/132 |
| 361,205 | 4/1887 | Burrows | 254/132 |
| 584,196 | 6/1897 | Rutherford | 254/132 |
| 879,526 | 2/1908 | Denovan | 254/132 |
| 882,447 | 3/1908 | Booth | 254/DIG. 3 |
| 911,098 | 2/1909 | Wenger . | |
| 943,322 | 12/1909 | Soles . | |
| 952,289 | 3/1910 | Wenger . | |
| 1,156,870 | 10/1915 | Aiazzi . | |
| 1,223,269 | 4/1917 | Goben . | |
| 1,288,223 | 12/1918 | Schmitt | 254/132 |
| 1,289,761 | 12/1918 | Hodges . | |
| 1,945,311 | 1/1934 | Gustafson | 254/132 |
| 2,394,568 | 2/1946 | Stewart | 254/132 |
| 3,077,336 | 2/1963 | McClelland | 254/132 |
| 4,097,021 | 6/1978 | Loboda . | |
| 4,256,286 | 3/1981 | Hudgins | 254/30 |
| 4,815,707 | 3/1989 | Brown . | |

*Primary Examiner*—Robert C. Watson

*Attorney, Agent, or Firm*—Haugen and Nikolai

[57] ABSTRACT

A tool for removing or raising landscape edging strips has a rigid main frame including two parallel and spaced apart bars, and an elongate upright lever. The lever is pivotally mounted to the main frame near its lower end, by a pivot pin extending through the bars and lever. A base pad is mounted to the main frame at an end remote from the pivot pin. Mounted to the main frame on the opposite side of the pivot pin, are a platform and a downwardly depending arm that supports a first clamp. A second clamp is mounted to the bottom of the lever, and moves arcuately as the lever pivots, to close both clamps about an enlarged upper border portion of the landscape edging material. Further pivoting of the lever, with the base pad against the ground, applied a vertical lifting force to the landscape edging strip, either to elevate and reposition the edging material, or to completely remove the edging material from the ground.

20 Claims, 2 Drawing Sheets

IMPLEMENT FOR REMOVING LANDSCAPE EDGING

BACKGROUND OF THE INVENTION

The present invention relates to extraction tools, and more particularly to a device for removing landscape edging material from the ground.

Landscape edging material is frequently employed in landscape gardening, to provide a distinct boundary between grassy areas and gardens, flower beds, and other landscape features. The edging material is constructed of a polymer that provides durability and sufficient rigidity for the material to be self-supporting. Typically available in rolls, the edging material is formable into linear, elongate strips or curved segments, depending upon the desired shape of the landscape feature.

The edging material has a uniform, generally rectangular cross section or transverse profile, with a width of about four inches and a thickness of about one quarter inch. Along one side of the strip, the lengthwise border or edge is enlarged, and usually has a rounded profile, either circular or elliptical.

In use, the material is cut to the desired length and embedded into the ground, with the width oriented vertically and most of the strip underground, leaving only the enlarged border exposed. The strip extends underground a sufficient distance to prevent the root system of a lawn from spreading from one side of the strip to the other, resulting in a well defined edge for the lawn, enhancing the appearance of the landscape.

On occasion, the need arises to remove previously installed landscape edging material, or at least alter its position. An entirely new landscaping plan may require substantial repositioning or removal, or merely slight adjustment of certain boundaries. Over time, strips of the material can become completely buried, losing some of their effectiveness in halting the advance of grass into flower beds and other features. In either event, a spade or other shovel can be used to remove or loosen soil on both sides of the strip, and lift or pry the strip loose. This approach, however, is time consuming, and disrupts or damages the appearance of the landscape, particularly along the grassy areas near the boundary. The ground along both sides of the strip is disturbed, whether the strip is being removed entirely, or merely being lifted to reposition the enlarged border above ground.

Therefore, it is an object of the present invention to provide a tool particularly well suited for removing landscape edging material.

Another object is to provide a device for lifting strips of landscape edging material that have become buried beneath the ground, and for repositioning the strips to locate their enlarged top borders above ground.

Yet another object is to provide a means for quickly and conveniently removing or repositioning landscape edging material, with minimal disruption to the surrounding landscape.

SUMMARY OF THE INVENTION

To achieve these and other objects, there is provided an implement for removing landscape edging material. The implement has an elongate and substantially rigid frame means with first and second opposite end portions. An elongate and generally upright lever is mounted to the frame means at its lower end section between the first and second end portions. The lever pivots relative to the frame means about a pivot axis. A first clamping means is mounted to the frame means at the second end portion, and has a first clamping face parallel to the pivot axis. A second clamping means is mounted to the lower end section of the lever and has a second clamping face, also parallel to the pivot axis. The second clamping means travels in an arc as the lever pivots, between a closed position wherein the first and second clamping means cooperate to substantially surround an enlarged border of an elongate landscape edging strip with the first and second clamping faces engaging opposite sides of the enlarged border, and a release position wherein the first and second clamping means are relatively remote from one another.

Preferably, both clamping faces are curved, to conform to the typically rounded exterior surface of the enlarged border. A generally flat pad, mounted to the first end portion of the frame means, is positioned to rest on the ground at a location spaced apart from the first and second clamping means when in the closed position. The pad supports the frame means as the operator, with one foot on the pad, pivots the top end of the lever in the direction toward the pad. With the clamping means closed about the enlarged border of the strip, the lever extends upright, to facilitate gripping and pivoting of the lever.

The preferred clamping means are C-shaped clamps, each centered with respect to the lever and frame means, and having a width, parallel to the pivot axis, at least three times the width of the lever. As a result, the clamping engagement occurs over a substantial portion of the surface area of the enlarged border, reducing the chance for damage to the landscape edging strip as it is being lifted or removed.

The frame means can include a pair of elongate, parallel and spaced apart bars, with the lever being mounted between the bars. The clamp that is integral with the bars is mounted to the bars by a clamp support arm, and the lever is positioned between the clamp support arm and the pad. A platform preferably is mounted to the ends of bars opposite from the pad, and near the clamp support arm. The platform is used to drive or push the clamps into the ground, to facilitate gripping the enlarged upper border of a completely buried edging strip.

Preferably the lever is positioned to be approximately upright when the pad is on the ground and the clamps are engaged about the upper border of the edging strip and of sufficient length to extend at least to the waist of a typical adult standing erect with one foot on the pad. Pivoting the lever to close the clamps and then lift the edging strip, does not require bending the back. Due to the positioning of the lever, lifting force is applied by moving the lever in the same direction as the initial pivoting to the closed position. Thus, lifting action tends to further tighten the grip about the upper edge or border of landscaping material. The length of the lever, as compared to the substantially shorter distance between the pad and the pivot axis, provides a mechanical advantage to facilitate lifting the embedded edging strip. A firm, positive grip of the clamps upon the upper border is maintained the entire time that a lifting force is applied. Accordingly, in situations where the edging material is merely raised, rather than completely removed in the ground, the implement provides for increased ease and accuracy of positioning the edging strip.

During lifting or removal of the edging, the lever and frame bars pivot about an axis along the pad and substantially parallel to the pivot axis. However, since the original pivot axis is directly above the edging strip when the clamps are closed about the upper border, the pivoting of the lever and main frame initially is equivalent to vertical lifting. As a result, force is applied in the direction of maximum efficiency for raising the edging material strip, and in a manner that causes minimum disruption of the soil on either side of the strip. Thus, in accordance with the present invention, landscaping edging material strips can be elevated or completely removed, conveniently and with minimal disruption to surrounding soil.

IN THE DRAWINGS

For a further appreciation of the above and other features and advantages, reference is made to the following detailed description and to the drawings, in which.

DETAILED DESCRIPTION OF THE PREFERRED EMBODIMENTS

Figure 1:
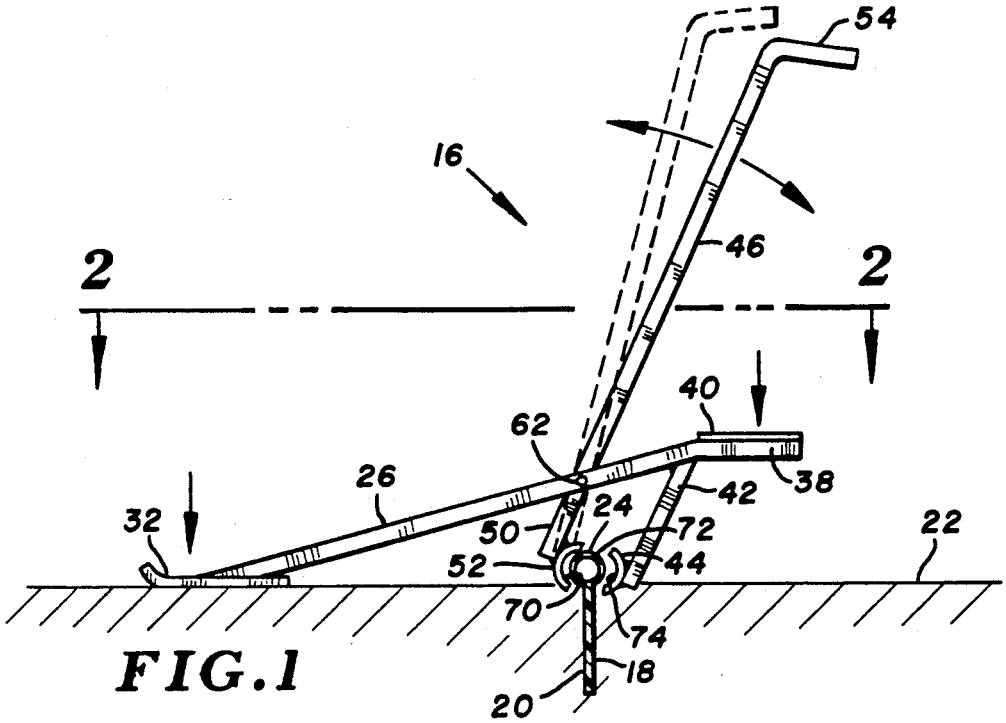
FIG. 1 is an elevational view of a landscaping tool constructed in accordance with the present invention.
Figure 2:
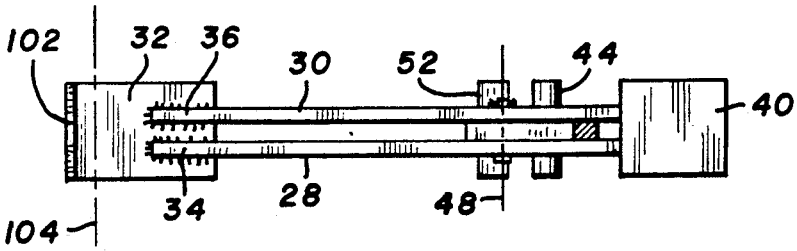
FIG. 2 is a top view partially in section, taken along the line 2—2 in FIG. 1.

Turning now to the drawings, there is shown in FIG. 1 a landscape gardening tool 16, used to lift or remove embedded landscape edging material. The material is in the form of an elongate edging strip extending longitudinally, shown at 18 in transverse profile. The profile is uniform throughout the length of the strip. Edging strip 18 includes a rectangular portion 20 buried below ground 22, and an enlarged upper edge or border 24 running lengthwise along the strip. Border 24 typically has a substantially circular profile, but also can be elliptical. Enlarged upper border 24 is intended to counteract the tendency of strip 18, over time, to become further embedded beneath the ground. As best seen in FIG. 2, tool 16 includes a main frame 26 consisting of two rectangular bars 28 and 30, parallel to and spaced apart from one another. Bars 28 and 30 can be constructed of cast iron or other suitable metal, to insure structural rigidity. The bars are secured by welding to a base pad 32, along respective end portions 34 and 36 of the bars. Opposite end portions of the bars, one of which is shown at 38 in FIG. 1, are welded to a platform 40. Near the platform, a clamp supporting arm 42 projects downwardly and toward the pad, i.e. to the left as viewed in FIG. 1. The upper end of arm 42 is welded to bars 28 and 30, to integrally secure the arm in a centered position between the bars. At its lower end portion, arm 42 supports a C-shaped clamp 44.

An elongate lever 46 is mounted to pivot relative to main frame 26, about a longitudinal pivot axis 48 (FIG. 2). Lever 46 is rectangular in cross section, and supported between bars 28 and 30 so as to be centered with respect to the main frame. A lower section 50 of lever 46 extends below the bars, and supports a C-shaped clamp 52 opposed to clamp 44. At the upper end of the lever is a handle 54.

Figure 4:
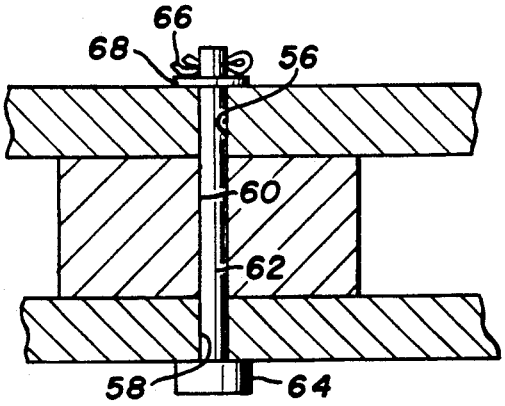
FIG. 4 is a sectional view taken along the line 4—4 in FIG. 3.

As seen in FIG. 4, aligned openings 56, 58 and 60 through bars 28 and 30 and lever 46, respectively, accommodate a pivot pin 6 that mounts the lever for pivoting between bars 28 and 30. Pin 62 includes an enlarged head 64 at one end, and is retained within the openings by a cotter pin 66 and washer 68 at the opposite end of the pin.

Clamps 44 and 52 oppose one another and are substantially identical in size and shape. An inside clamping surface 70 of clamp 44 is curved to conform to the rounded exterior surface 72 of upper border 24. Clamp 52 similarly has a curved clamping surface 74 which conforms to the upper edge. Each of clamps 44 and 52 is oriented with its length dimension and its clamping surface longitudinally, i.e. parallel to pivot axis 48. The length of clamps 44 and 52 approximately equals the width of base pad 32 and of platform 40, and is about twice the combined widths of bars 28 and 30 and lever 46, all of which are vertical as viewed in FIG. 2.

Figure 3:
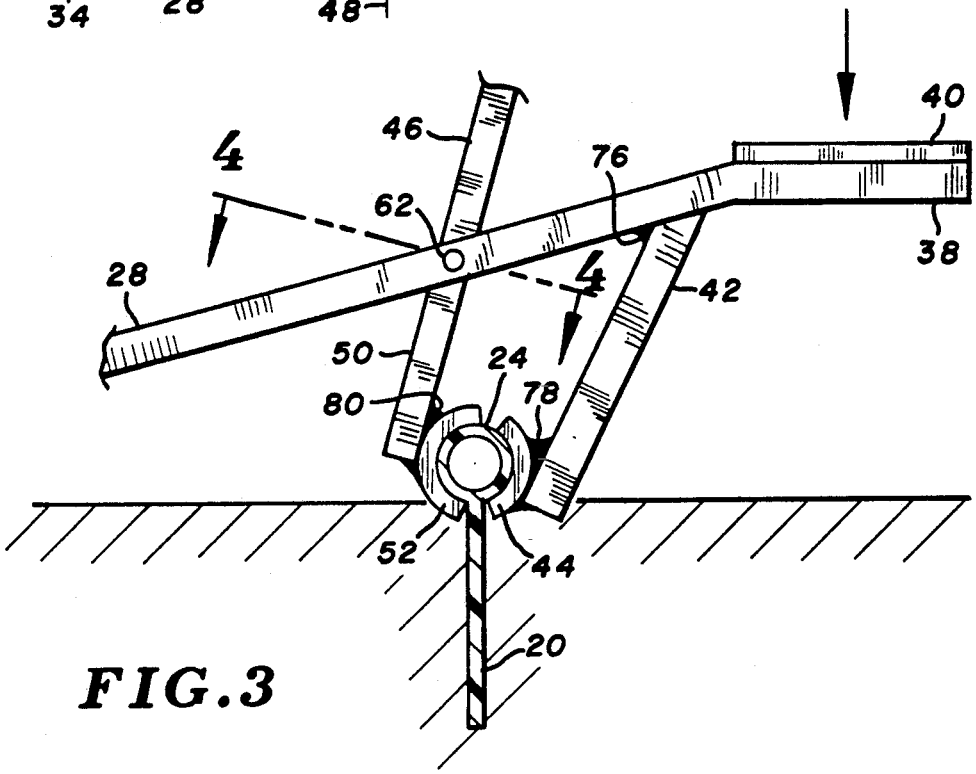
FIG. 3 is an enlarged view showing a portion of FIG. 1.

As best seen in FIG. 3, a weld at 76 secures arm 42 to the bars, a weld at 78 secures clamp 44 to arm 42, and a weld 80 secures clamp 52 to lower section 50 of lever 46.

In FIG. 3, clamps 44 and 52 are shown in the closed position, in which they cooperate to substantially surround upper border 24, with clamping surfaces 70 and 74 contiguous with exterior surface 72 of the upper border, conforming to the exterior surface. This degree of conformity is desirable but by no means essential, as upper border 24 (within limits) resiliently conforms to the clamping surfaces. The clamping surfaces should, however, be rounded and concave toward the upper border, for maximum clamping efficiency. As seen in FIG. 3, a portion of clamping surface 70 and a portion of clamping surface 74 are disposed beneath border 24 when the clamps are closed.

As best seen in FIG. 3, pin 62 is positioned directly above upper border 24 and clamps 44 and 52, and lever 46 is substantially upright (although slightly inclined), when the clamps are in the closed position about the upper border. This arrangement facilitates use of tool 16 by an operator standing with one foot on base pad 32 and the other foot on the ground on the opposite side of edging material strip 18, i.e. on the right side as viewed in FIG. 1. Given this stance, lever 46 is at least approximately centered relative to the operator. Moreover, the lever is made sufficiently long to extend to at least waist height of the operator, so that the operator need not bend over when using the device.

Figure 5:
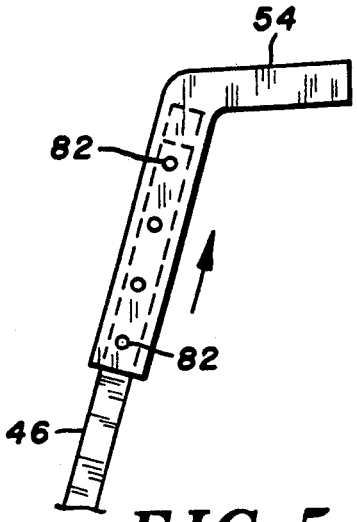
FIG. 5 is an enlarged view showing a portion of FIG. 1.

To insure an appropriate length for the lever, handle 54 can be adjustably mounted as shown in FIG. 5, in which a series of apertures 82 along the handle can be selectively aligned with corresponding apertures through lever 46, secured by a bolt or other appropriate means.

Figure 6:
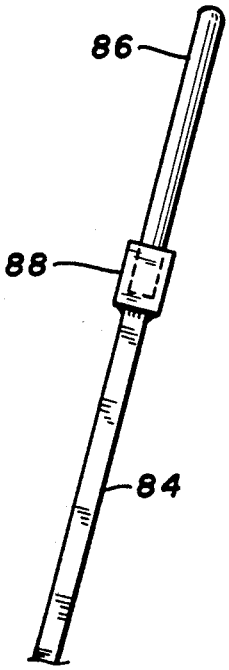
FIGS. 6 and 7 are views of alternative embodiments of a lever handle of the tool.

FIG. 6 shows an alternative form of lever 84 for the device, in which a handle 86, preferably of wood, is removably inserted into a socket 88 formed at the top of lever 84. Handle 86 is elongate and extends in the direction of lever extension.

Figure 7:
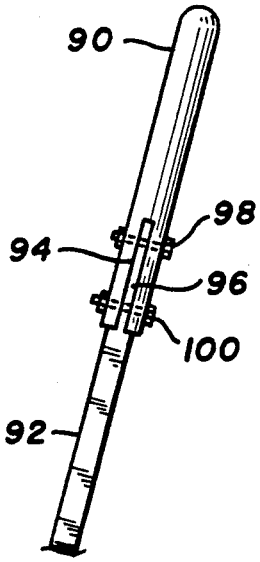

Similarly, FIG. 7 illustrates a wooden handle 90 that extends in the direction of a lever 92. A slot 94 is formed in handle 90, and conforms to a bracket 96 that extends outwardly from lever 92. Nut and bolt assemblies 98 and 100, contained in openings through the handle and bracket, removably secure the handle.

Regardless of whether tool 16 is used to slightly raise embedded landscape edging strip 18, or to completely remove the edging strip from the ground, the tool first is positioned for use as shown in FIG. 1, with base pad 32 resting on the ground, and with clamps 44 and 52 near upper border 24 and on opposite sides of the upper border. Occasionally, the enlarged border is partially or completely beneath ground 22, requiring that the clamps be pushed into the ground. To this end, bars 28 and 30 are bent such that section 38 and the corresponding end section of bar 30 are approximately level, and platform 40 is likewise level. By placing one foot on platform 40 and shifting his or her weight onto the platform, the operator can conveniently force clamps 44 and 52 below ground, to the level of the upper border.

With clamps 44 and 52 aligned with upper border 24, lever 46 is rotated in the counterclockwise direction as viewed in FIG. 1, to close the clamps about the upper border. At this point, the operator places one foot on base pad 32 and continues to pivot lever 46 in the counterclockwise direction. Whereas lever pivoting prior to closure was about pivot axis 48, movement of the lever after closure pivots the lever, and main frame 26, about an axis 102 along the base pad and parallel to axis 48. The distance between base pad 32 and pivot pin 62 preferably is at least three times the distance between pivot pin 62 and clamp 52. Due to the length of bars 28 and 30 between pin 62 and the base pad, particularly as compared to the relatively short length of lever lower section 50, the initial pivoting of the main frame and lever about axis 102 carries pin 62 essentially vertically in the early stages of its arcuate traverse. The travel of clamps 44 and 52 is likewise essentially vertical at this stage. Thus, the force applied through the clamps to elevate or remove edging strip 18 is substantially vertical, for maximum efficiency.

Due to the weight of the operator, and to the downward force of base pad 32 as lever 46 is pivoted to lift the edging strip, there is a substantial force tending to drive the base pad into the ground, particularly along an edge 104 remote from pivot pin 62. The tendency of the base pad to dig into the ground, and perhaps damage a lawn or other landscape feature, is minimized in that 104 is upturned to provide a smooth, rounded surface rather than a sharp corner along the ground.

During lifting or the edging strip, clamps 44 and 52 remain firmly engaged about enlarged border 24 in the closed position. As a result, the pivoting of lever 46 and main frame 26 controls the vertical travel of the edging strip. The degree of control is particularly advantageous where the intent is to elevate a partially buried edging strip, rather than to completely remove the strip.

Due to the length of clamps 44 and 52 in the longitudinal direction along upper edge 24, the lifting force is distributed over a relatively large surface area of the upper edge. This minimizes any damage to the upper edge due to the lifting force or to the closure of the clamps, enabling the strip to be raised without damage for continued use, or preserving a completely removed strip for future use.

Thus, in accordance with the present invention, landscape edging material embedded into the ground can be raised or completely removed conveniently and without unduly disrupting the ground on either side of the edging, to better preserve the appearance of landscaping features along the path of the edging strip. The tool provides a positive clamping action about the enlarged upper border of the edging, in combination with a main frame and lever arranged to apply an essentially vertical lifting force after clamping, resulting in an efficient, controlled application of lifting force. The clamps conform to the upper border and distribute the lifting force over a relatively large area of the border, to substantially prevent damage to the edging material as it is elevated or removed from the ground.

What is claimed is:

1. An implement for removing landscape edging material from the ground, including:

an elongate and substantially rigid frame means having first and second opposite end portions;

an elongate and generally upright lever, and means for mounting a lower end section of the lever to the frame means between said first and second end portions, for pivoting of the lever relative to the frame means about a longitudinal pivot axis;

a first clamping means mounted to the frame means at the second end portion thereof and having a first clamping face parallel to the pivot axis;

a second clamping means mounted to the lower end section of the lever and having a second clamping face parallel to the pivot axis, said second clamping means traveling in an arc as the lever pivots, between a closed position wherein the first clamping means and second clamping means cooperate to substantially surround an enlarged border generally circular in profile and running lengthwise of an elongate landscape edging strip with the first and second clamping faces engaging opposite sides of the enlarged border and with respective first and second portions of the first and second clamping faces disposed beneath the enlarged border, and a release position wherein the first and second clamping means are relatively remote from one another;

a generally flat and rectangular pad mounted to the first end portion of the frame means and positioned to rest upon the ground at a location spaced apart from the first clamping means on the opposite side of the landscape edging strip from the first clamping means, said pad being curved along one side remote from the lever parallel to the pivot axis to form an upturned edge;

wherein the first clamping face and second clamping face are curved to conform to a rounded exterior surface of the enlarged border; and wherein the frame means includes a pair of elongate, parallel and spaced apart bard, and a clamp support arm extended downwardly from the bars and supporting the first clamping means at its lower end, and wherein the pad is secured to the bars at respective first ends thereof.

2. The implement of claim 1 wherein:

the first and sec-nd clamping means comprise first and second C-shaped clamps, each centered with respect to the lever in the longitudinal direction.

3. The implement of claim 2 wherein:

each of said clamps has a width, in the longitudinal direction, at least three times the width of the lever.

4. The implement of claim 1 wherein:

said lever is pivotable to a substantially upright position to move the second clamping means into the closed position with the pad on the ground, and wherein the lever extends upwardly to at least waist height of a typical adult standing erect with one foot on the pad.

5. The implement of claim 4 wherein:

said lever is adjustable in length.

6. The implement of claim 1 further including:

an elongate handle, and a socket formed in the upper end portion of the lever for removably receiving the handle.

7. The implement of claim 1 further including:

a bracket extended upwardly from an upper end of the lever, and an elongate handle having a slot conforming to the bracket to facilitate a releasable fastening of the handle to the lever via the bracket.

8. The implement of claim 1 wherein:

said means for mounting the lever comprises a pivot pin extended through the bars and the lever at a location between the pad and the clamp support arm.

9. The implement of claim 8 further including:

a substantially flat platform mounted to respective second ends of the parallel bars opposite the first ends.

10. The implement of claim 9 wherein:

the clamp support arm is mounted near the platform.

11. The implement of claim 1 wherein:

the pivot axis is positioned substantially directly above the enlarged border when the first and second clamping means are in the closed position and the pad is on the ground.

12. The implement of claim 11 wherein:

the distance between the pad and the pivot axis is at least three times the distance between the pivot axis and the second clamping means.

13. An implement for handling previously installed landscape edging material, including:

an elongate and substantially rigid frame means having first and second opposite end portions;

an elongate and generally upright lever, and means for mounting a lower end section of the lever to the frame means between the first and second end portions,, for pivoting of the lever relative to the frame means about a longitudinal pivot axis;

a first clamp mounted to the frame means at the second end portion thereof and having a first clamping face parallel to the pivot axis;

a second clamp mounted to the lower end section of the lever and having a second clamping face parallel to the pivot axis, said second clamp traveling in an arc as the lever pivots, between a closed position wherein the first and second clamps cooperate to substantially surround an enlarged border running lengthwise of an elongate landscape edging strip and having a generally circular transverse profile with the first and second clamping faces engaging opposite sides of the enlarged border and with respective first and second portions of the first and second clamping faces disposed beneath the enlarged border, and a release position wherein the first and second clamps are relatively remote from one another, said first and second clamping faces conforming to an exterior surface of the enlarged border;

a generally flat pad mounted to the first end portion of the frame means and positioned to rest upon the ground at a location spaced apart from the first clamp on the opposite side of the landscape edging strip from the first clamp; and a substantially flat platform mounted to the second end portion of the frame means; wherein the frame means includes a clamp support arm mounted near the platform and extended downwardly, and supporting the first clamp at its lower end.

14. The implement of claim 13 wherein:

each of the first and second clamps is curved bout an axis parallel to said pivot axis and elongate in the direction of the pivot axis.

15. The implement of claim 14 wherein:

each of said clamps has a width, in the longitudinal direction, at least three times the width of the lever.

16. The implement of claim 13 wherein:

the pad is rectangular, and curved along one side remote from the lever parallel to the pivot axis to form an upturned edge.

17. The implement of claim 13 wherein:

said means for mounting the lever comprises a pivot pin extended through the frame means and the lever at a location between the pad and the clamp support arm.

18. The implement of claim 13 wherein:

the clamp support arm is mounted near the platform.

19. The implement of claim 13 wherein:

the pivot axis is positioned substantially directly above the enlarged border when the second clamp is in the closed position and the pad is on the ground.

20. The implement of claim 19 wherein:

the distance between the pad and the pivot axis is at least three times the distance between the pivot axis and the second clamp.

* * * * *